US007077539B2

(12) United States Patent
Sheng

(10) Patent No.: US 7,077,539 B2
(45) Date of Patent: Jul. 18, 2006

(54) STATIONERY HOLDER WITH LUMINOUS REMINDER

(76) Inventor: Wang Chun Sheng, 2F, No. 50, Taihe St. Cidu District, Keelung 206 (TW)

( * ) Notice: Subject to any disclaimer, the term of this patent is extended or adjusted under 35 U.S.C. 154(b) by 10 days.

(21) Appl. No.: 11/014,996

(22) Filed: Dec. 20, 2004

(65) Prior Publication Data

US 2006/0133071 A1 Jun. 22, 2006

(51) Int. Cl.
*F21V 33/00* (2006.01)

(52) U.S. Cl. ..... 362/109; 362/98; 362/190; 362/201; 362/205; 362/658; 200/61.59

(58) Field of Classification Search ..... 362/109, 362/98, 99, 190, 201, 205, 658; 200/310–314, 200/317, 318, 308, 61.59, 61.58 R, 51.09; 40/463, 464, 465, 661.02; 206/575, 576, 206/224, 214, 411
See application file for complete search history.

(56) References Cited

U.S. PATENT DOCUMENTS 1,352,349 A * 9/1920 Bua ..... 362/99
6,302,563 B1 * 10/2001 Yama ..... 362/253

* cited by examiner

*Primary Examiner*—Sandra O'Shea
*Assistant Examiner*—Sharon Payne
(74) *Attorney, Agent, or Firm*—Rosenberg, Klein & Lee

(57) ABSTRACT

Disclosed is a stationery holder includes a base having an upper portion, which defines first and second compartments for respectively receiving a roll of adhesive tape and a pen and a card receptacle between the compartments, and a lower portion, which forms a battery chamber for receiving and retaining a battery. An illuminator is mounted in the first compartment and is electrically connected to the battery by a switching device arranged in the receptacle. The switching device includes a fixed conductive contact and a deformable conductive plate that has a spring section engaging a sidewall of the receptacle and floatingly supporting a switching section that is spaced from the contact for a small distance. When a card is inserted between the sidewall and the conductive plate, the spring section deforms and moves the switching section to physically engage the contact thereby forming a closed electrical loop among the illuminator, the battery, and the switching device for powering the illuminator.

3 Claims, 3 Drawing Sheets

STATIONERY HOLDER WITH LUMINOUS REMINDER

BACKGROUND OF THE INVENTION

1. Field of the Invention

The present invention generally relates to a stationery holder, and in particular to a stationery holder having a card receptacle that is operatively coupled to an illumination system whereby an illuminator lights up the stationery holder to indicate the presence of the card or a reminder note.

2. The Related Art

A stationery holder is commonly placed on the top of a desk to hold various stationeries, such as adhesive tape roll, paper clips, pens, and name cards, for convenient access of a user. The stationery holders that are available in the market are of substantially the same construction, which forms a number of cells or compartments, which may be of different shapes and sizes, to receive and hold different kinds of stationery. In other words, these conventional stationery holders are designed to receive and hold substantially the same kinds of stationery, and the conventional stationery holder provides no additional function rather than holding stationery.

It is thus desired to exploit additional functions of a stationery holder by incorporating a luminous reminder in the stationery holder, which reminds a user of jobs that are to be done or to call a person, whereby a more useful desktop device may be obtained.

SUMMARY OF THE INVENTION

Therefore, a primary objective of the present invention is to provide a stationery holder having a luminous reminder that issues a luminous indication to a user for reminding purposes.

Another objective of the present invention is to provide a stationery holder forming a card receptacle in which a switching device that electrically connects an illuminator to a power source is mounted, whereby when a card is positioned in the receptacle, the illuminator gives off light to remind a user of the card and messages put down on the card.

To achieve the above objectives, in accordance with the present invention, a stationery holder is provided. The stationery holder comprises a base having an upper portion, which defines first and second compartments for respectively receiving a roll of adhesive tape and a pen and a card receptacle between the compartments, and a lower portion, which forms a battery chamber for receiving and retaining a battery. An illuminator is mounted in the first compartment and is electrically connected to the battery by a switching device arranged in the receptacle. The switching device comprises a fixed conductive contact and a deformable conductive plate that has a spring section engaging a sidewall of the receptacle and floatingly supporting a switching section that is spaced from the contact for a small distance. When a card is inserted between the sidewall and the conductive plate, the spring section deforms and moves the switching section to physically engage the contact thereby forming a closed electrical loop among the illuminator, the battery, and the switching device for powering the illuminator.

By placing a card, such a name card and a notepaper, in the receptacle, the illuminator is energized to light up the stationery holder, giving an indication to the user regarding the card in the receptacle, which may serve as a reminder for the user. This provides the stationery holder with an additional function.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
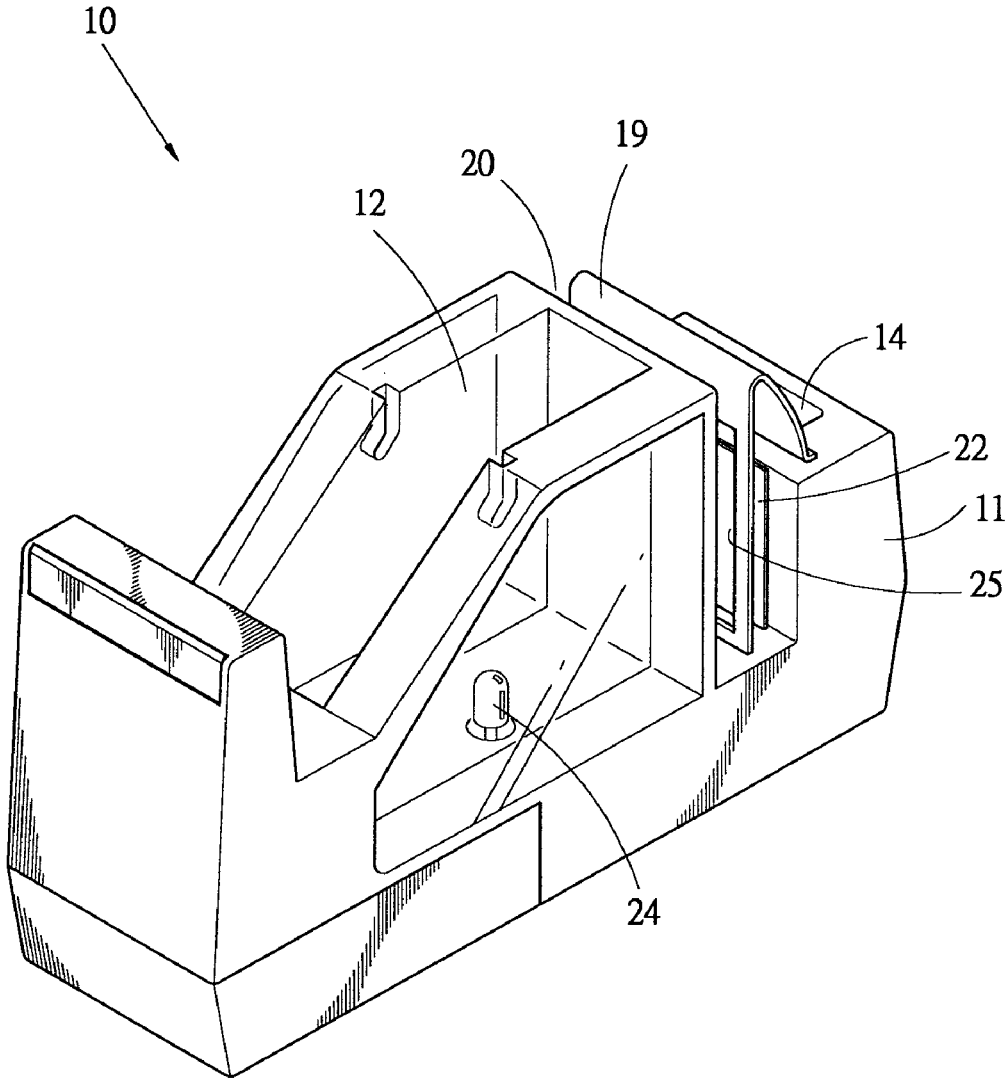
FIG. 1 is a perspective view of a stationery holder constructed in accordance with the present invention.
Figure 2:
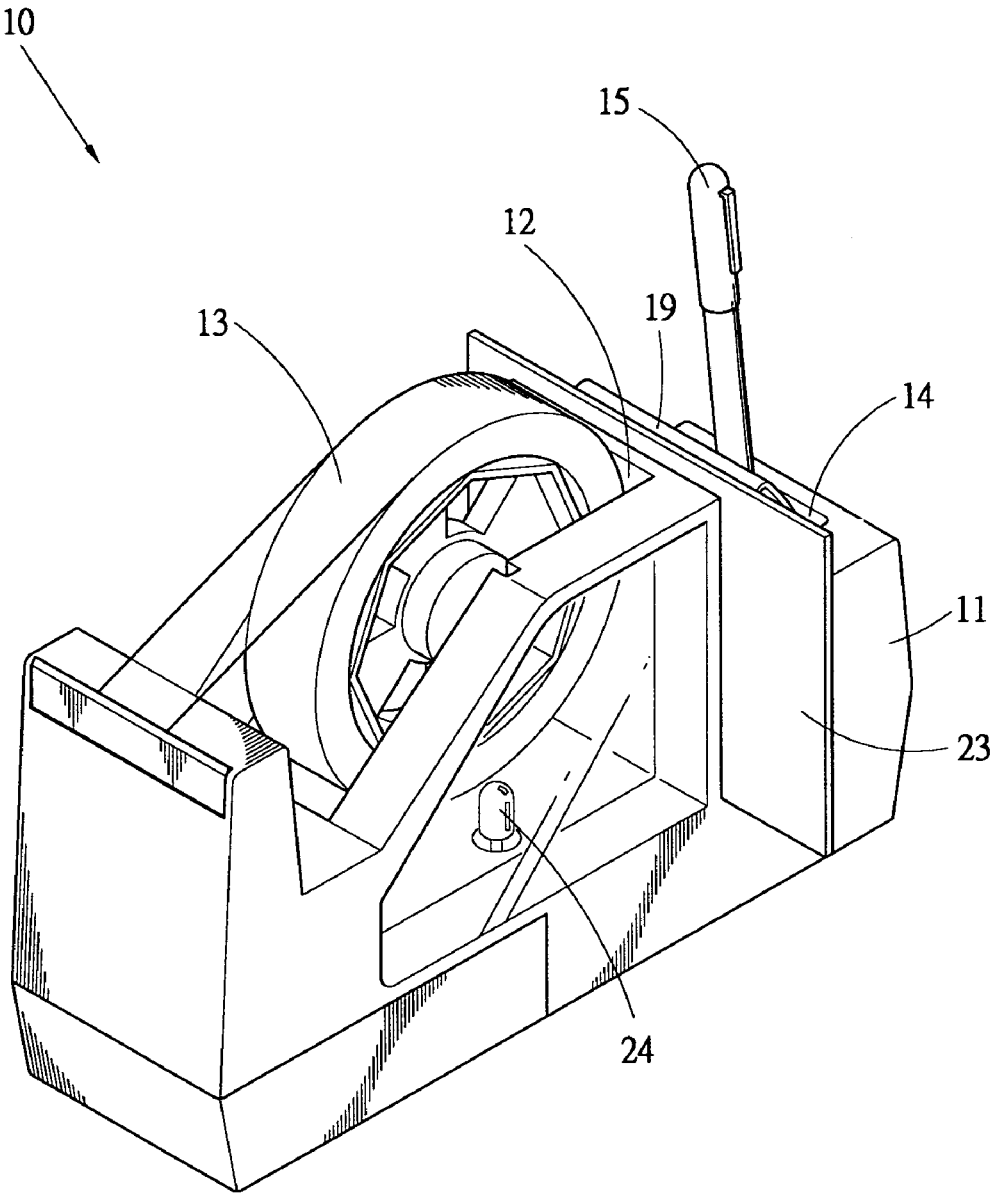
FIG. 2 is a perspective view, similar to FIG. 1, but showing the stationery holder receives and holds stationeries, including at least an adhesive tape roll and a pen.
Figure 3:
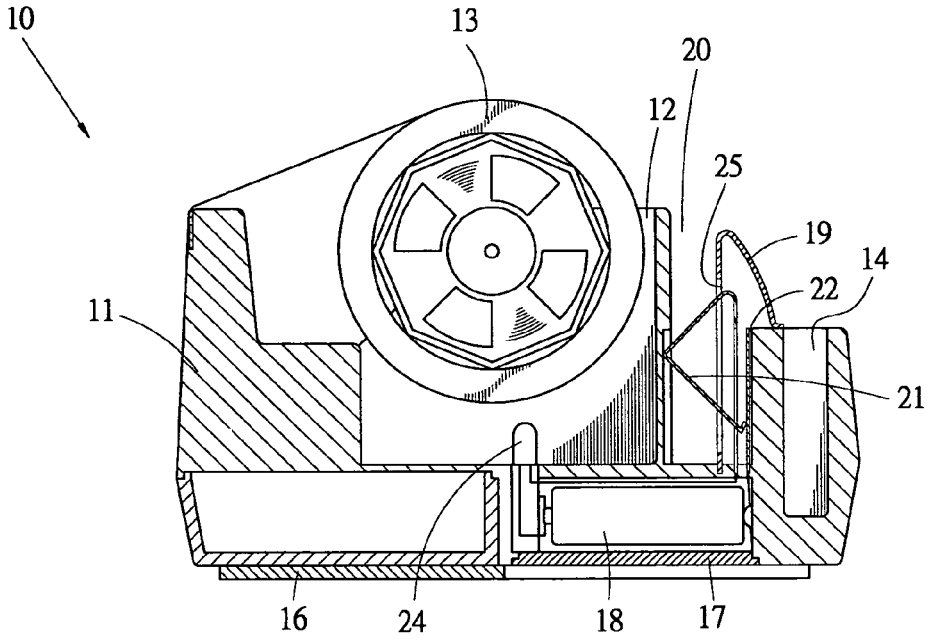
FIG. 3 is a cross-sectional view of FIG. 2, with the pen removed for simplicity and clear illustration.

With reference to the drawings and in particular to FIGS. 1–3, a stationery holder constructed in accordance with the present invention, generally designated with reference numeral 10, comprises a base 11 that, similar to a conventional stationery holder, forms a first compartment 12 in an upper portion at a front end thereof to receive and hold a roll of adhesive tape 13 and a second compartment 14, which may receive and hold a slender stationery, such as a pen 15, in the upper portion at an opposite rear end thereof. The base 11 also forms, in the top thereof, a third compartment 20, serving as a card receptacle, between the first and second compartments 12, 14, for receiving a card 23 (see FIG. 4), such as a name card, a notepaper, and a reminder card.

The base 11 has a bottom face to which a friction pad 16 is attached to securely position the stationery holder 10 on for example the top of a desk (not shown.

The base 11 also has a lower portion that defines a battery chamber (not labeled) having an entry opening, also not labeled, closed by a removable lid 17, through which entry opening a battery 18 is positioned in the battery chamber to serve an a built-in power source. An additional chamber (not labeled) is also defined in the base 11 to receive and retain an illuminator 24 that is electrically connected to the power source 18 to be powered thereby for giving off light. The illuminator 24 may comprise an electrical bulb that can be directly powered by the battery 18, or the illuminator may comprise an electronic lighting element, such as a light-emitting diode that is controlled by a circuit board (not shown) powered by the power source 18. The illuminator 24 partially projects into the first compartment 12 below the tape roll 13. Since a large clearance is present around the tape roll 13 to allow for rotation of the tape roll 13 in dispensing the tape, the light emitted from the illuminator 24 transmits through the clearance and lights up the upper portion of the stationery holder 10.

A switching device is arranged in the card receptacle 20 that is delimited by opposite front and rear walls (both not labeled). The switching device comprises a resilient conductive plate 21 and a fixed conductive contact 22, both received in the card receptacle 20 in a spaced manner and respectively connected to the illuminator 24 and the battery 18 whereby when the plate 21 physically engages the contact 22, a closed electrical loop is formed among the battery 18, the illuminator 24, the conductive plate 21, and the contact 22, which energizes the illuminator 24 to give off light.

In the embodiment illustrated, the conductive contact 22 is fixed to the rear wall of the card receptacle 20. The conductive plate 21 is mounted to the base 11 and comprises a spring section (not labeled) resiliently engaging the front wall of the card receptacle 20 and floatingly supporting a switching section (not labeled) that extends toward the conductive contact 22 and is spaced therefrom a small distance.

The switching device may also comprise a shielding cover 19 arranged to shield above the conductive plate 21 and the contact 22 to protect the plate 21 and the contact 22 from undesired engagement with objects that are made of conductive material. The shielding cover 19 comprises a flat section arranged in the card receptacle 20 between the front and rear walls to protect the conductive contact 22 and a curved connection section arranged above the plate 21 and the contact 22 and extending from a top edge of the flat section to the rear wall. The flat section of the cover 19 defines an opening 25 for the extension of the conductive plate 21 therethrough.

Figure 4:
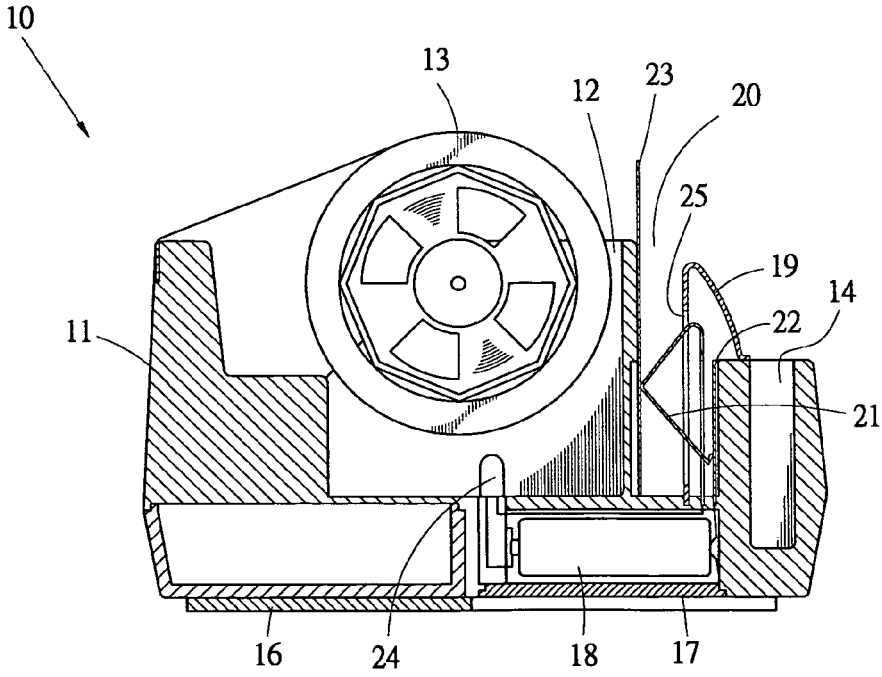
FIG. 4 is similar to FIG. 3, but showing a card is received in a card receptacle of the stationery holder of the present invention.

Also referring to FIG. 4, when a card 23, such as name card and a notepaper, is forcibly fit between the front wall of the receptacle 20 and the spring section of the conductive plate 21, the spring section deforms and moves the switching section of the conductive plate 21 toward the contact 22, whereby the conductive plate 21 engages the contact 22, completing the closed electrical loop among the battery 18, the illuminator 24, the conductive plate 21, and the contact 22. Power is thus supplied from the battery 18 to the illuminator 24, which in turn gives off light to light up the stationery holder 10, which may be considered as lighting decoration, and/or to remind a user of the card 23 in the receptacle 20.

When the card 23 is removed, the switching section of the conductive plate 21 is allowed to retreat and thus separated from the contact 22. Therefore, the electrical loop among the battery 18, the illuminator 24, the conductive plate 21, and the contact 22hannel 13 is opened and power supplied from the batteries 18 to the illuminator 24 is cut off. The illuminator 24 is thus turned off.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A stationery holder comprising:

a base having an upper portion and a lower portion, the upper portion defining at least first and second compartments adapted to respectively receive and hold stationeries and a receptacle between the first and second compartments for insertion of a card therein, and the lower portion defining a battery chamber receiving and retaining a battery;

an illuminator mounted to the base and arranged in the first compartment; and a switching device arranged in the receptacle and electrically connecting the illuminator to the battery, the switching device comprising first and second spaced conductive members, at least one of which is selectively movable to engage the other one by the insertion of the card whereby a closed electrical loop is formed among the illuminator, the battery, and the first and second conductive members through which the illuminator is energized by power from the battery.

2. The stationery holder as claimed in claim 1, wherein the first conductive member comprises at least a spring section that resiliently engages a sidewall of the receptacle and supports a switching section spaced from the second conductive member a predetermined distance and wherein the insertion of the card between the sidewall and the spring section causes deformation of the spring section to move the switching section over the predetermined distance to engage the second conductive member.

3. The stationery holder as claimed in claim 2, wherein the switching device further comprises a shielding cover arranged above the first and second conductive members.

* * * * *